United States Patent [19]

Crowe

[11] 3,996,699

[45] Dec. 14, 1976

[54] REFRIGERATOR DOOR CLOSURE APPARATUS

[75] Inventor: William P. Crowe, Louisville, Ky.

[73] Assignee: General Electric Company, Louisville, Ky.

[22] Filed: July 14, 1975

[21] Appl. No.: 595,788

[52] U.S. Cl. ..... 49/386; 49/383; 292/74

[51] Int. Cl.[2] ..... E05F 1/10

[58] Field of Search ..... 49/383, 386, 388, 402; 292/DIG. 17, DIG. 71, 73–75; 16/144, 141

[56] References Cited

UNITED STATES PATENTS

| | | | |
|---|---|---|---|
| 1,831,800 | 11/1931 | Bales et al. | 49/386 X |
| 2,392,689 | 1/1946 | Peglow | 49/386 X |
| 2,557,749 | 6/1951 | Lundane | 49/386 |
| 3,124,848 | 3/1964 | Wheeler et al. | 49/386 X |
| 3,432,967 | 3/1969 | Simon | 49/386 |

*Primary Examiner*—Kenneth Downey
*Attorney, Agent, or Firm*—Francis H. Boos

[57] ABSTRACT

A door of a household refrigerator has a cam cooperating with a striker. The cam is biased into forcible contact with the striker and is of a configuration for urging the door toward the closed position in response to contacting of a first cam portion and the striker.

6 Claims, 5 Drawing Figures

REFRIGERATOR DOOR CLOSURE APPARATUS

BACKGROUND OF THE INVENTION

In a present form of refrigerator design, desirable door-closing forces are exerted on the door by adjusting the legs of the refrigerator in a manner such that the refrigerator has a slight rearwardly-directed tilt. In this position, the weight of a partially-closed door urges the door toward the closed position.

This system functions satisfactorily but has the problem of requiring careful alignment. This alignment is sometimes difficult, particularly where the floor supporting the refrigerator is relatively uneven. Further, movement of the refrigerator for cleaning the floor often causes the setting of the adjustable legs to become misadjusted.

It is therefore desirable to provide apparatus which produces a positive door-closing force that is not dependent upon the attitude of the refrigerator. Further, it is desirable that the apparatus be of simple construction and vertically spaced from the refrigerator hinges so that the apparatus can be easily serviced and will not interfere with any water-delivery conduit system which may pass through the hinges on those refrigerators providing chilled water service.

SUMMARY OF THE INVENTION

In accordance with this invention, a household refrigerator has a front door frame, a door, and means for pivotally connecting the door to the front door frame.

A striker is mounted on one of the front door frame or door and projects into the space between the frame front face surface and the door inner surface. A cam is mounted in the other of said front door frame or door at a location adjacent the striker and also projects into the space between the frame and door. The cam is biased into forcible contact with the striker biasing means. The cam has a first portion of a configuration sufficient for exerting a preselected force on the door for urging the door toward the closed position in response to contact of the first cam position and the striker.

DETAILED DESCRIPTION OF THE INVENTION

Figure 1:
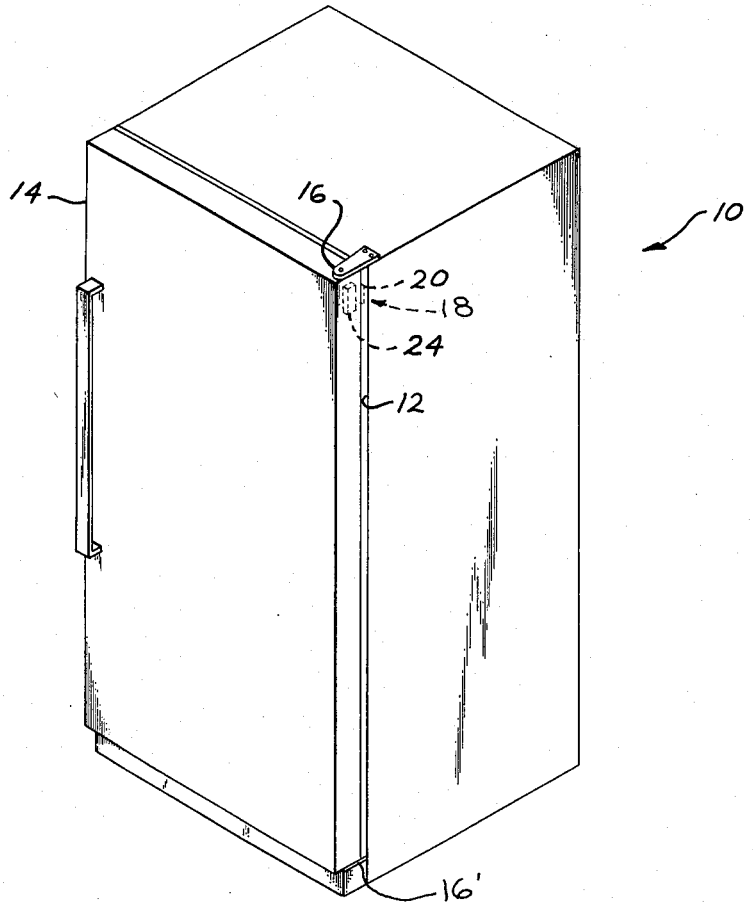
FIG. 1 is a perspective view of a refrigerator having the apparatus of this invention.

In FIG. 1, a household refrigerator 10 of the construction type now commonly in use includes a front door frame 12 having a front face surface 22. A door 14 is mounted over the frame 12 and has a confronting surface 13 (FIGS. 2–4) overlapping and spaced from the frame face surface 22. The refrigerator 10 further includes conventional hinges 16, 16′ for pivotally connecting the door 14 to the door face 12. As is conventional, the pivotal axis defined by the hinge pivot point 17 is spaced from the confronting surface 15 in a direction toward the door outer surface 19.

The apparatus of this invention, shown generally by numeral 18, is mounted on the refrigerator 10 at a location vertically spaced from the hinges 16, 16′ in order to provide easy access to the apparatus for adjustment, replacement, and to avoid interference with any water-supply system or wiring that might be associated with one of the hinges 16.

Figure 2A:
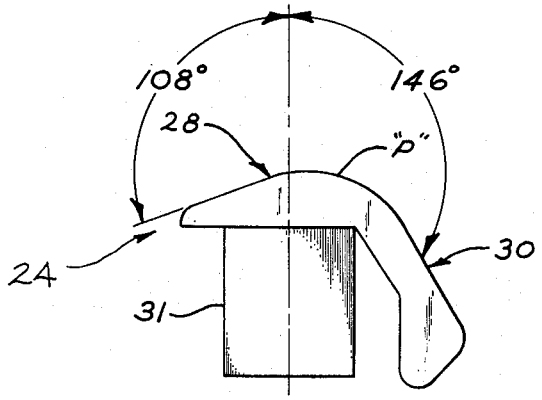
FIG. 2A is a diagrammatic view of the cam of FIG. 2.
Figure 2:
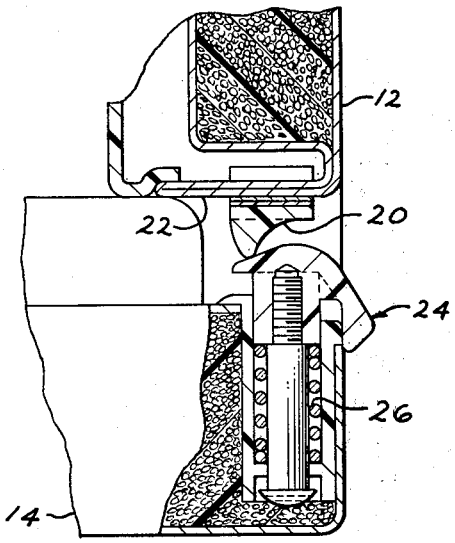
FIG. 2 is a diagrammatic partially sectioned view showing the apparatus of this invention.

In the embodiment of FIG. 2, a striker 20 is mounted on the face surface 22 of the refrigerator front door frame 12 and a cam 24 is movably mounted on the door confronting surface 13 at a location adjacent the striker 20. As shown, the striker 20 and the cam 24 each project from their respective mounting surfaces 22 and 13 into the space between the frame face surface 22 and the confronting surface 13 for slidable engagement with one another. It should be understood that the positions could be reversed with the striker 20 mounted on the door confronting surface 13 and the cam 24 mounted on the frame face surface 22.

The cam 24 is biased by a biasing means 26 into forcible contact with the striker 20. The biasing means 26 can be, for example, a helically-coiled spring, as hereafter more fully discussed with reference to FIG. 4.

Referring to FIG. 2A, the cam 24 has a first portion 28 that is of a configuration sufficient for exerting a preselected force on the door 14 for urging the door 14 toward the closed position in response to the forcible contacting of the cam first portion 28 and the striker 20. This cam first portion 28 extends along the area of the cam 24 contacted by the striker 20 when the door 14 of the refrigerator 10 is between a completely closed position and a position at which the door is about one-half open.

By so constructing the cam first portion 28, the door 14 is urged toward the closed position when the door is less than about one-half open or is disposed at an angle relative to the sidewall face 22 of less than about 45°. It should be understood, however, that the cam first portion 28 can be constructed for closing the door over a greater or lesser range without departing from this invention and that the above-described range is for example purposes only.

It is preferred that the cam 24 has a second portion 30 that is of a configuration for urging the door toward the fully-open position in response to forcible contacting of the cam second portion 30 and the striker 20. In this construction, after the refrigerator door 14 is opened to a position past an intermediate point P, forces are applied to the door for moving it to the fully-open position in order to assist a user in gaining easy access to food items within the refrigerator 10. In the example above, the intermediate point P is that point where the striker 20 contacts the cam 24 when the door is at an angle of about 45° relative to the face 22 of the sidewall 12, although the exact angle and corresponding point is a matter of choice.

Figure 3:
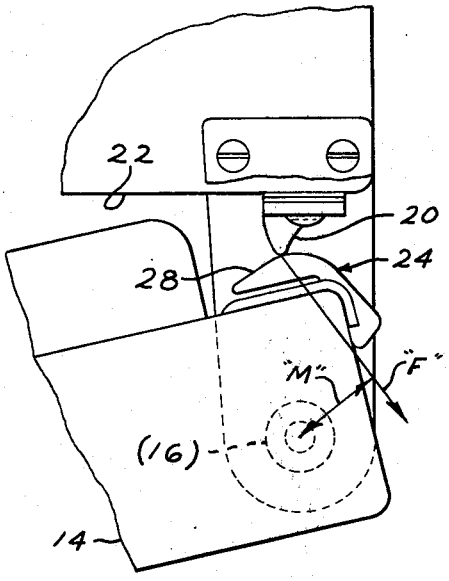
FIG. 3 is a diagrammatic view of the apparatus of this invention with the door in a partially-opened position.

Referring to FIG. 3, it can be seen that in the partially-opened position of the door 14, the striker 20 is forcibly contacting the angularly-disposed cam first portion 28 which exerts a closing force upon the door 14. The force exerted by the biasing means is directed normally to the surface of the cam first portion 28. Since the striker 20 is fixed, a reaction force F is directed onto the door 14. This reaction force F has a movement M from the hinge 16 which urges the door 14 to pivot clockwise relative to the hinge pivot point 17. Similarly, when the striker 20 is contacting the cam second portion 30, the reaction force is positioned on the left side of the hinge pivot point 17 which urges the door 14 to pivot counterclockwise relative to the hinge pivot point 17.

Figure 4:
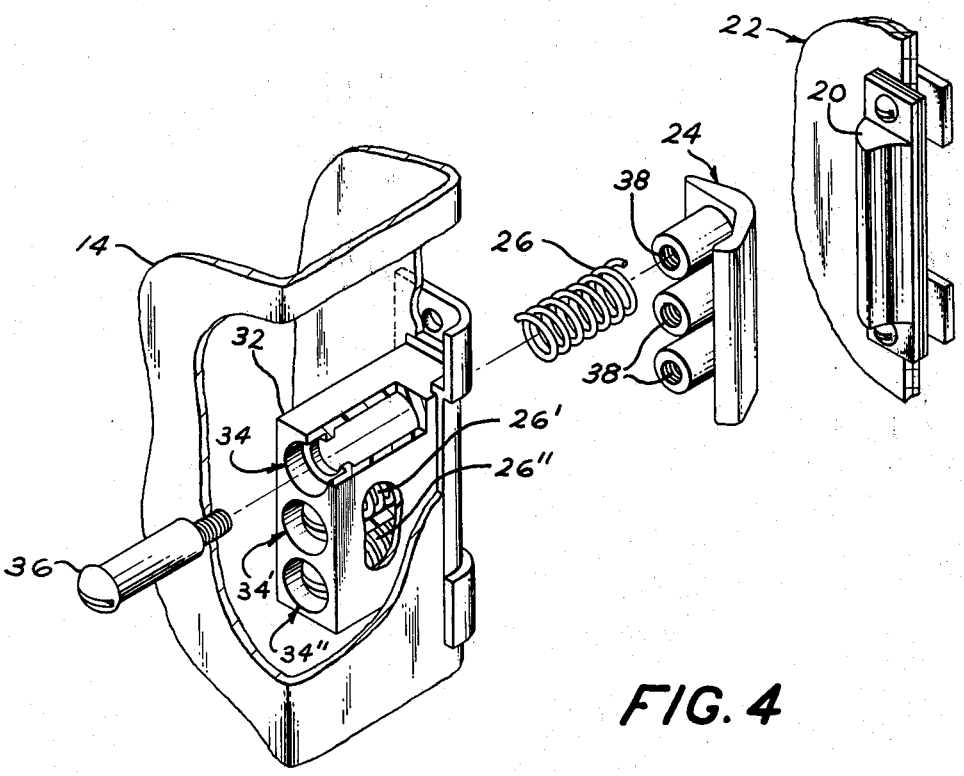
FIG. 4 is an exploded view of the apparatus of this invention.

In the embodiment of FIG. 4, a housing 32 is connected to the door 14 and is constructed with chambers 34, 34', 34'', each receiving a biasing means 26, 26', 26''. A threaded member 36, for example a screw, extends through each chamber 34, 34', 34'' and is matable with respective threads 38 formed on the cam 24.

An apparatus of this invention that was constructed as shown in the following example provided the desired functions.

EXAMPLE

| | |
|---|---|
| Housing | |
| Chambers | 3 |
| Diameter | 1.12 Cm |
| Length | 2.59 Cm |
| Spring | |
| Type | Helical |
| Number | 3 |
| Diameter | 1.03 Cm |
| Length | 3.38 Cm |
| Force | 5 Kg. at 1.45 Cm deflection |
| Striker | |
| Radius of contacting portion | .051 Cm |
| Cam | |
| First portion (28) | 108° from center line of shaft 31 |
| Second portion (30) | 146° from center line of shaft 31 |

Other modifications and alterations of this invention will become apparent to those skilled in the art from the foregoing discussion, and it should be understood that this invention is not to be unduly limited thereto.

What is claimed is:

1. In a household refrigerator of the type including a door frame having a front face surface, a door mounted over the frame and having a confronting surface overlapping and spaced from the frame face surface, and means for pivotally connecting the door to the door frame, the pivotal axis being spaced from the confronting surface in a direction towards the door outer surface, the improvement comprising:

a striker mounted on one of the frame face surface or confronting surface and projecting from the surface on which it is mounted into the space between the frame face surface and the confronting surface;

a cam movably mounted on the other of said frame face surface or confronting surface at a location adjacent the striker and projecting from the surface on which it is mounted into the space between the frame face surface and the confronting surface for slidable engagement with the striker, said cam being biased into forcible contact with the striker and having a first portion of a configuration sufficient for urging the door toward the closed position in response to contact of said first cam portion and said striker; and means for so biasing said cam.

2. Apparatus, as set forth in claim 1, in which said cam includes a second cam portion having a configuration sufficient for urging the door toward the open position in response to forcible contact of said second cam portion and said striker.

3. Apparatus, as set forth in claim 1, wherein the biasing means is a helically-coiled spring.

4. Apparatus, as set forth in claim 1, wherein the biasing means is a plurality of helically-coiled springs.

5. Apparatus, as set forth in claim 1, including:

a housing connected to the door and receiving the biasing means; and a threaded member extending through the housing and being matable with threads of the cam with said biasing means contacting and urging the cam against the striker.

6. Apparatus, as set forth in claim 1, wherein the striker and cam are vertically spaced from the means for pivotally connecting the door to the sidewall.

* * * * *